US012145773B2

(12) United States Patent
Van Drunen et al.

(10) Patent No.: US 12,145,773 B2
(45) Date of Patent: Nov. 19, 2024

(54) CLOSURE FOR CLOSING AN ACCESS SIDE OF A FLEXIBLE PACKAGING, COIL COMPRISING A CLOSURE STRIP AND USE THEREOF

(71) Applicant: Schutte Bagclosures B.V., Uden (NL)

(72) Inventors: Frank Emil Léon Van Drunen, Schijndel (NL); Mieke Petronella Hendrina Verweijen, 'S-Hertogenbosch (NL); Petrus Jacobus Johannes Van Hooff, Uden (NL)

(73) Assignee: Schutte Bagclosures B.V., Uden (NL)

( * ) Notice: Subject to any disclaimer, the term of this patent is extended or adjusted under 35 U.S.C. 154(b) by 33 days.

(21) Appl. No.: 17/925,869

(22) PCT Filed: May 19, 2021

(86) PCT No.: PCT/EP2021/063317

§ 371 (c)(1),
(2) Date: Nov. 17, 2022

(87) PCT Pub. No.: WO2021/234011

PCT Pub. Date: Nov. 25, 2021

(65) Prior Publication Data

US 2023/0182966 A1 Jun. 15, 2023

(30) Foreign Application Priority Data

May 19, 2020 (NL) ..... 2025617

(51) Int. Cl.
*B65D 33/16* (2006.01)
*B65D 77/18* (2006.01)

(52) U.S. Cl.
CPC ..... *B65D 33/1616* (2013.01); *B65D 77/18* (2013.01)

(58) Field of Classification Search
CPC .... B65D 33/1616; B65D 33/12; B65D 33/10; Y10T 24/157; Y10T 24/153; Y10T 24/15; Y10T 24/1498
See application file for complete search history.

(56) References Cited

U.S. PATENT DOCUMENTS 3,470,685 A 10/1969 Hall et al.
5,154,964 A * 10/1992 Iwai ..... B65D 63/12 24/30.5 R (Continued)

FOREIGN PATENT DOCUMENTS

DE 36 89 547 T2 8/1994
WO 99/15330 A1 4/1999

OTHER PUBLICATIONS

International Search Report and Written Opinion from Application No. PCT/EP2021/063317 dated Jul. 15, 2021.

(Continued)

*Primary Examiner* — Robert Sandy
*Assistant Examiner* — Michael S Lee
(74) *Attorney, Agent, or Firm* — Troutman Pepper Hamilton Sanders LLP; Ryan A. Schneider; Andrew C. Doherty

(57) ABSTRACT

An elongate closure (10; 110) for closing an access side of a flexible packaging comprises an elongate plastic body (12; 112), wherein the body (12; 112) has a first face (22; 120) that is turned towards the access side of the flexible packaging in a closed position, a second face (24; 122) that is turned away from the access side of the flexible packaging in a closed position, and at least one thickened rib (14, 16; 114) extending over the length of the body (12; 112), wherein the at least one thickened rib (14, 16; 114) has at least two projecting parts (26; 124) separated by a recess (Continued)

(28; 126) at the second face (24; 122). The elongate closure can be a clip band type closure or a twist tie type closure.

29 Claims, 3 Drawing Sheets

(56) References Cited

U.S. PATENT DOCUMENTS

| | | | | |
|---|---|---|---|---|
| 5,238,631 | A * | 8/1993 | Stolk | B65D 63/12 264/177.17 |
| 5,607,748 | A * | 3/1997 | Feltman | B65D 77/18 428/167 |
| 5,774,955 | A * | 7/1998 | Borchardt | B65D 33/255 24/584.1 |
| 5,827,461 | A | 10/1998 | Feltman | |
| 2003/0135959 | A1 * | 7/2003 | Wales | A44B 99/00 24/30.5 R |
| 2011/0097018 | A1 * | 4/2011 | Turvey | B65D 33/01 383/63 |

OTHER PUBLICATIONS

Search Report from Netherland Application No. 2025617 dated Sep. 3, 2021.

* cited by examiner

CLOSURE FOR CLOSING AN ACCESS SIDE OF A FLEXIBLE PACKAGING, COIL COMPRISING A CLOSURE STRIP AND USE THEREOF

CROSS-REFERENCE TO RELATED APPLICATIONS

This application is a § 371 national stage of International Application PCT/EP2021/063317, with an international filing date of 19 May 2021, which International Application claims the benefit of NL 2025617, filed on 19 May 2020, the benefit of the earlier filing date of which is hereby claimed under 35 USC § 119 (a)-(d) and (f). The entire contents and substance of all applications are hereby incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

SEQUENCE LISTING

Not Applicable

STATEMENT REGARDING PRIOR DISCLOSURES BY THE INVENTOR OR A JOINT INVENTOR

Not Applicable

BACKGROUND OF THE DISCLOSURE

1. Field of the Invention

The invention relates to an elongate closure for closing an access side of a flexible packaging, which closure comprises an elongate plastic body, wherein the body has a first face that is turned towards the access side of the flexible packaging in a closed position, a second face that is turned away from the access side of the flexible packaging in a closed position, and at least one thickened rib extending over the length of the body.

2. Description of Related Art

Elongate closures having a central thickened rib, often referred to as "twist tie or "twist band", as well as elongate closures having thickened ribs at the longitudinal edges, often referred to as "clip band", are known in the field of packaging of for example food and feed. Generally, the rib comprises a (metal) wire that is embedded in the plastic body. After the packaging has been filled, in particular with food stuffs, such as bakery products or confectionery, for example bread, gingerbread, sugar, sweets and the like, the access side is folded together to form a neck which can, if desired, be twisted. In case of a twist tie closure having a central rib the ends of the closure are folded around the neck, the first face of the closure facing the neck, and then twisted together. In case of clip band closure having ribs at the edges, the closure is folded around the neck and bent, so that the ends of the closure overlap one another. These situations, wherein the ends of the closure are either twisted around the neck of the packaging, either overlap one another clamping the neck defines the closed position. The traditional closures consist of an elongate strip made of plastic, such as polypropylene, with a metal wire being embedded along the centre line of the plastic body or at both longitudinal edges thereof. The metal wire imparts clamping force to the closure, so that the closure remains in the closed position and engages and clamps the locally gathered neck of the packaging, even when being re-used, including reclosing the same packaging using the same closure.

Therefore it is desired that these closures have a combination of bending and stretch properties allowing to fold and unfold the closures multiple times (sometimes indicated by "repeat number") without the occurrence of necking, weakening of strength, fracture or other type of failure along the line(s) of folding or twisting, while at the same time the closures should be able to maintain their closing position after bending or twisting and only upon applying a considerable force can be opened. This latter property is also known as "dead fold".

In packaging food or feed in the food/feed industry clipband closures are usually fitted by a machine. To this end, the closure material is wound onto a bobbin or coil as a single strip having a virtually continuous length (for example 500 m or more), a portion of which (in the order of magnitude of centimetres) is in each case cut off in the packaging device and is used as a separate closure. Also the twist tie closures are commercially available as separate closures or assembly thereof, wherein individual closures are connected side by side by means of connecting legs that are broken before use of the closure, or as a strip wound onto a coil.

As the traditional metal wire thickened closures consist of two different materials, the plastic body and the metal wire(s), in processing used closures as they appear in garbage and the like as waste, separation of plastic and metal parts is required. This is cumbersome. In view thereof closures made from a single material would allow easier management of waste from (used) closures. Actually the food/feed industry demands such closures made from mono material. However, the (re)closing properties of the closures may not be compromised.

In the field several proposals for mono material clip band closures are known. E.g. EP2455298A1 of the present applicant discloses a clip band closure having a tiny additional rib on the thickened longitudinal edges comprising plastic embedded reinforcing wires at the access side thereof for providing extra grip on the flexible packaging. In an embodiment thereof the reinforcing wires are made from metal. These closures are sold by the name Clipband Xtragrip®. According to EP2455298A1 the wires may also be made of plastic material, preferably the same plastic material as the body.

WO99/150330A1 discloses a wireless twist tie from a copolymer composition of PC and ABS or PC and PBT. The twist tie comprises a wing and at least one rib. In some embodiments the twist tie includes multiple ribs having webs of the body extending between these ribs and interconnecting them.

Likewise U.S. Pat. No. 5,827,461A discloses a wireless polymeric twist tie from a non-metallic polymeric composition comprising a wing and at least one rib. In an embodiment the twist tie comprises a pair of ribs interconnected by a web portion of the wing.

Also DE3689547T2 discloses a similar polymeric twist tie having a thickened rib.

BRIEF SUMMARY OF THE INVENTION

Now the present inventors have observed upon testing closures from mono plastic material (herein mono refers to the fact that the plastic material of the closure is typically not separated in its constituting components in waste treatment like a metal wired plastic closure) that the thickened part that is twisted and/or bended can show plastic deformation in an undesirable extent like necking and even fracturing, at the outside of the twist or bend, which deteriorates the clamping force of the twisted or bended closure and reduces the possibilities of re-use. Similarly at the inside of a twist or bend of the closure from mono plastic material the plastic is compressed and can bulge, which counteracts the clamping force.

The present invention aims at avoiding one more of the above drawbacks of mono material closures of these types, or at least limiting these drawbacks to some extent, thereby improving the closing properties of the closures, as well as enhancing the re-use potential thereof.

According to the invention the at least one thickened rib of the elongate closure has at least two projecting parts separated by a recess at the second face. The invention is based on providing additional plastic material by the projecting parts of the thickened rib at the position where it is needed most upon deformation by bending or twisting, that is to say at the outside of the twist or bend, in order to maintain the strain (elongation) caused by the stress of bending or twisting in the plastic deformation area of the plastic material but avoiding strain at which the plastic material at the outside fractures, while the recess provides space for the contracted material to bend or twist at a smaller radius than a similar prior art closure having a traditional thickened rib without projections separated by a recess, and thus less strain is induced, thereby avoiding the risk of fracturing.

Generally, it suffices to provide each thickened rib with two projecting parts separated by one recess, although multiple (more than two) projections per thickened rib, wherein each projection is separated from a neighbouring one by a recess, are contemplated.

In order to allow easy use of the closure according to the invention by end consumers and in automatic packaging lines wherein appropriate orientation of the closure by facing the first face towards the gathered neck of the packaging is no longer required, in a preferred embodiment the thickened rib also has at least two projecting parts separated by a recess at the first face. Preferably the closure is symmetrical. Then the orientation of the protrusions does not matter and an end consumer cannot be mistaken, nor can an operator load the closures or coiled strip thereof in an erroneous orientation in the packaging machine.

Moreover, the compressed material of the projecting parts at the first face, i.e. at the inside of the bend or twist, can deform into the recess between those projections, thereby reducing the resistance to bending or twisting and has a smaller counteracting effect on the dead fold.

In a clip band embodiment of the closure according to the invention the closure comprises two thickened ribs at the longitudinal edges of the body, which ribs are spaced apart in the width direction of the body. Thus both longitudinal edge ribs have at least two projecting parts at the second face, preferably at the second face and the first face, of the body, as explained above. In an advantageous embodiment thereof, the outermost projecting part at the second face and the outermost projecting part at the first face are separated by a recess, hereinafter also referred to as side recess to distinguish it from the recess between projections at the second face and the first face. The omission of plastic material at the position of this side recess allows the plastic material of the outermost projection of the thickened rib at the first face to bend into this side recess, while the projecting parts of the same thickened rib at the second face essentially remain their position.

In an advantageous embodiment this side recess between the outermost projecting part at the second face and the outermost projecting part at the first face has a curved bottom, in particular a circular arc section, in view of manufacturing by means of extrusion without any sharp angled corners between the recess and the adjacent projecting parts.

In a twist tie embodiment of the closure of the invention the rib is arranged at the longitudinal centre line of the body, wherein preferably the rib has projecting parts separated by a recess at both the first and second face. The wing parts adjacent the rib extending in the width direction of the body are typically thin in order to allow deformation providing irregular edges that provide resistance to sliding of the twisted ends of the closure with respect to one another thereby maintaining sufficient holding (clamping) force on the neck of the packaging. In an advantageous embodiment the projecting parts have a rounded top, preferably a circular arc section, thereby avoiding the risk of damaging the packaging, which might affect the quality and quantity of the packed product, in particular the shelf life of food or feed.

For the same reasons of production and avoiding sharp angles as explained above with respect to the side recess, advantageously the recess between the projecting parts at the second face and/or the recess between the projecting parts at the first face has a curved bottom, preferably a circular arc section. Additionally a curved recess avoids the risk that packaging material cannot get stuck in sharp angled corners between the recess and adjacent projecting parts and be damaged.

Preferably the radius of the rounded top of a projecting part is larger than the radius of the curved bottom, thereby providing a large contact area with the packaging and sufficient material to counteract high strain, while the recess still offers sufficient space for the elastically deformed projecting parts.

An individual elongate closure according to the invention, which typically depending on its intended use has a length of a few centimetres, typically 3-10 cm, up to a few tens of centimetres, for example 75 cm. The width of the closure is usually in a range of 5-12 mm, such as 8 mm. The thickness of the body, i.e. the part adjacent the ribs, is usually a few tenths of a millimeter, such as 0.2-0.5 mm, for example 0.3 mm. Compared to the body, the thickened ribs including the projecting parts have a greater thickness, such as a total thickness of 0.5-1.5 mm, such as 0.6, 0.7, 0.8 mm or 1.2 mm. At the position of the recess at the second face the thickness of the rib is larger than the thickness of the body. Thus the perpendicular distance between the lowest part (bottom) of the recess at the second face and the centre plane of the body is >0.5*thickness of the body. Typically this distance is in the range of 0.6-1.1*thickness of the body, or even higher. This also applies to the recess, if present, at the first face of the closure. In other words, in such an embodiment the distance between the bottom of the recess at the second face and the bottom of the recess at the first face is larger than the thickness of the body. For example, in a clip band embodiment of a closure according to the invention the body has a thickness of 0.4 mm, the largest thickness of the rib including the projecting parts at both faces is 1.2 mm and the thickness of the rib at the position of the recesses at the first and second face is 0.8 mm. Generally, in a twist tie embodiment the body is even thinner, while the dimensions of the rib and recess are similar to those of the clip band embodiment.

In the clip band closure according to the invention having a side recess the bottom of the recess is positioned such that it does not intersect the centre line through the outermost projecting parts of the thickened rib at the first and second face of the closure.

The type of plastic materials having deadfold properties is not particularly limited. Suitable examples include (high density) poly ethylene ((HD)PE), poly propylene (PP), poly ethylene terephthalate (PET), modified poly ethylene terephthalate, such as PETG, poly lactic acid (PLA), poly carbonate (PC), biobased polymers like PEF (polyethylene 2,5-furandicarboxylate). Preferred plastics are thermoplastics.

Typically the closure according to the invention is manufactured by extrusion the polymer and usual additives like impact modifiers and colorants. The manufacturing method can include an optional stretching step.

Preferably the plastic can be sealed, that is to say overlapping ends or twisted ends of the closure according to the invention can be connected, for example by heat sealing, (ultrasonic) welding and the like, to one another, such that upon disconnecting the ends a detectable mark, e.g. a mark visible by the human eye, such as a sign of damage, is generated in order to provide a temper proof closure.

The closure according to invention is preferably manufactured from one and the same plastic material, preferably as an integral product, wherein the body and the at least one thickened rib form a single entity and are made of the same plastic.

The invention also relates to the various variants wherein the closures are typically put on the market, in particular as a coil with an elongate plastic strip wound onto it for use in a packaging device, which strip comprises a plastic body having an upper face and a lower face and at least one thickened rib extending over the length of the body, wherein the thickened rib has at least two projecting parts separated by a recess at the upper face, as well as at least two projecting parts separated by a recess at the lower face. In a packaging machine, individual closures are cut from the strip. As in the coiled strip both the upper and lower faces have projecting parts separated by a recess like in the preferred embodiments of the individual closures having projecting parts separated by a recess at the first and second faces, it does not matter how the coil strip is loaded in the packaging machine.

The strip can be a strip for clip band applications, wherein the strip comprises two thickened ribs at the longitudinal edges of the body, which ribs are spaced apart in the width direction of the body.

The strip can also be a strip for twist tie applications, wherein the rib is arranged at the longitudinal centre line of the body. For twist tie applications the individual closures may also be an assembly of individual closures of the twist tie type, that are arranged parallel and side by side at their wing parts that are interconnected by a plurality of connecting bridges.

The preferred and advantageous embodiments as explained above with respect to an individual closure according to the invention also apply to the coiled strip.

The invention also relates to the use of a closure according to the invention or a coil according to the invention in the closing of the access side of a flexible packaging, preferably in a packaging machine.

BRIEF DESCRIPTION OF THE DRAWINGS

The invention is further illustrated by the attached drawings, wherein.

DETAILED DESCRIPTION OF THE INVENTION

Figure 1:
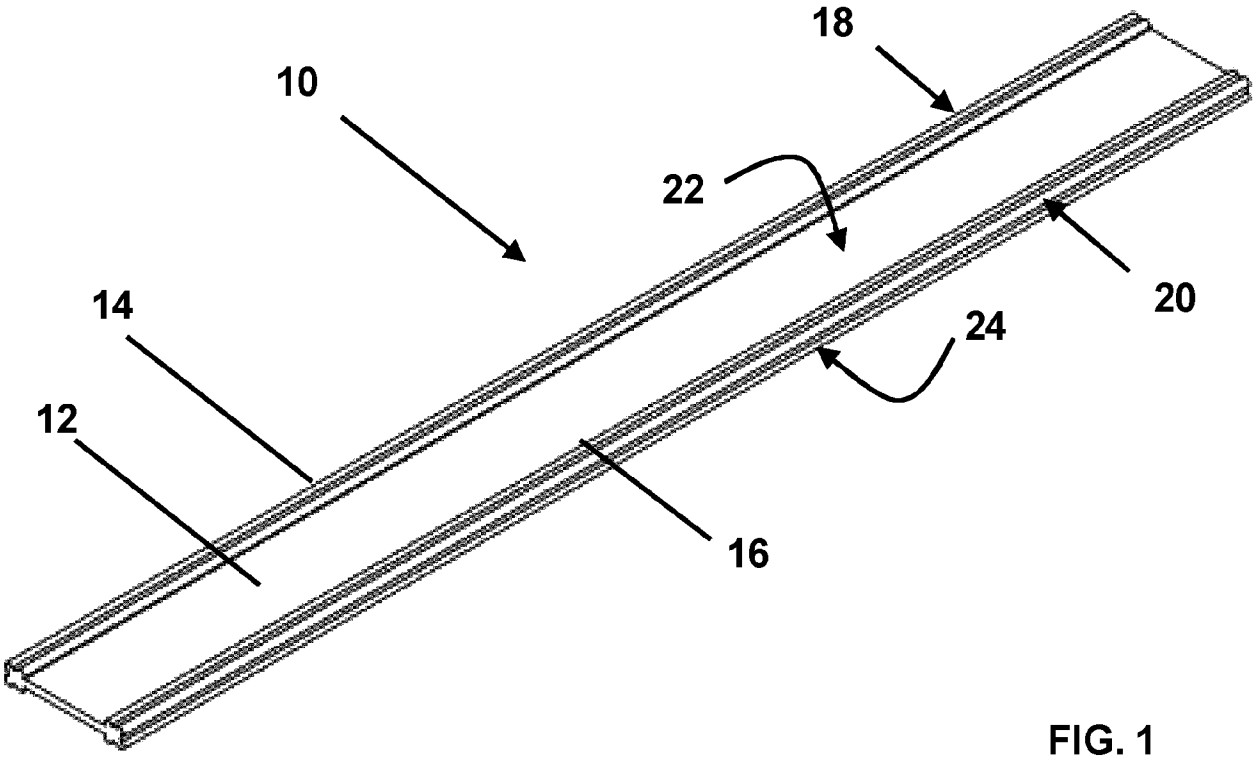
FIG. 1 shows a view of an embodiment of a clip band type closure according to the invention.

In FIG. 1 an embodiment of a single elongate closure of the clip band type according to the invention is shown that is indicated in its entirety by reference numeral 10. It will be understood that in a coiled strip only the length would differ. The closure 10 comprises an elongate body 12 of plastic material having thickened ribs 14 and 16 respectively along its longitudinal edges 18 and 20 and a first face 22 and second face 24 (upper face respectively lower face in a strip according to the invention).

Figure 2:
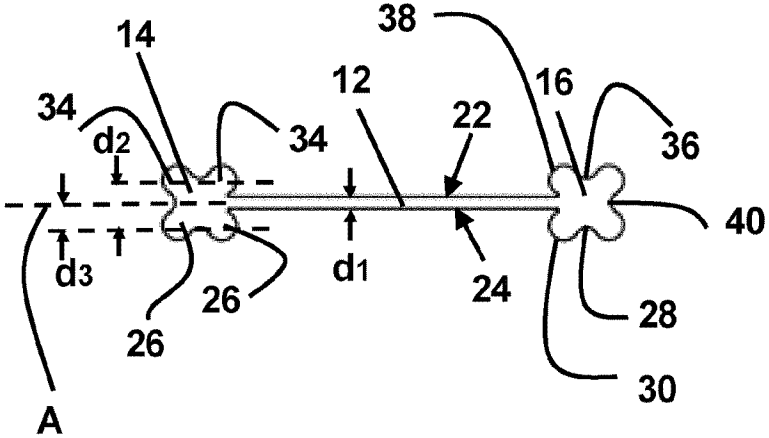
FIG. 2 shows a cross section of the embodiment of FIG. 1.

FIG. 2 shows a cross section of the embodiment of FIG. 1, from which the details of the ribs 14 and 16 can be derived. At the second face 24 each of the ribs 14, 16 has two projecting parts 26 that are separated by a recess 28. Each projecting part 26 has a curved, in particular rounded top 30. The recess 28 has a curved bottom. Similarly at the first face 22 each of the ribs 14, 16 has two projecting parts 34 that are separated by a recess 36. A projecting part 34 has a curved (rounded) top 38, while the recess 36 has a curved bottom. At the longitudinal edges 18 and 20 a side recess 42, also having a curved bottom, is present between the outermost projecting part 26 at the second face 24 and the outermost projecting part 34 at the first face 22. The centre plane of the body 12 is indicated by "A". The body 12 has a thickness d1. The distance d2 represents the thickness of the elongated rib 14 between the bottoms of the recess 36 at the first face 22 and the bottom of the recess 28 at the second face 24. As can be seen the distance d3 between the bottom of the recess 28 at the second face 24 and the centre plane A is larger than 0.5*d1.

Figure 3:
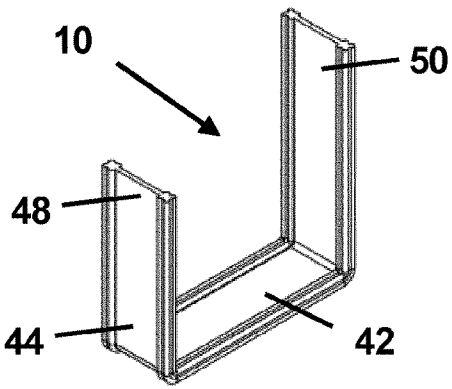
FIG. 3 shows the embodiment of FIG. 1 in a partially closed condition; \

FIG. 3 shows the embodiment of a clip band closure 10 of FIGS. 1-2 in an U condition, with a bottom part 42 and legs 44 and 46 bended at right angles to the bottom part 42.

Figure 4:
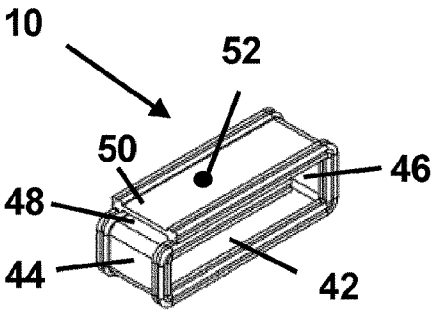
FIG. 4 shows the embodiment of FIG. 1 in a closed condition.

FIG. 4 shows this embodiment of a clip band closure 10 in a closed condition, wherein the ends 48 and 50 are further bended at right angles with respect to the legs 44 and 46, such that the end 50 overlaps the end 48. A seal 52 locally connecting the end 50 to the end 48 is applied for visible inspection that a packaging, the neck of which is contained in the closure (in the closed condition thereof), has not been accessed in an unauthorized manner.

Figure 5:
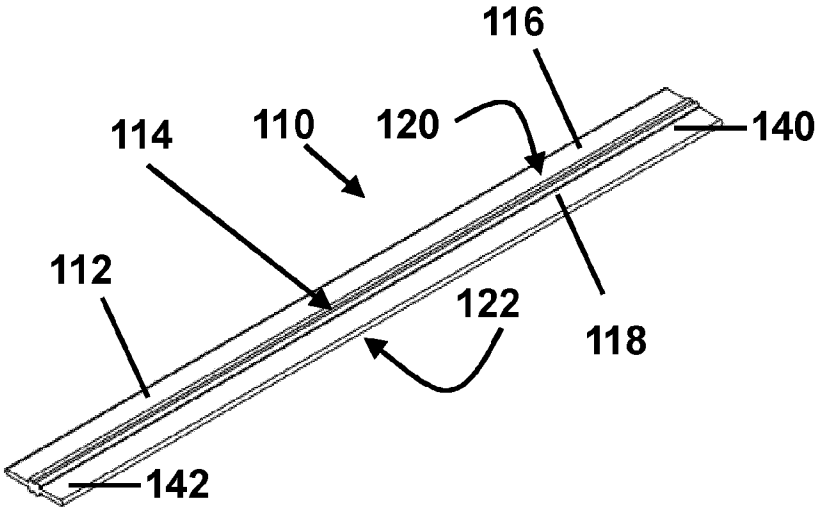
FIG. 5 shows a view of an embodiment of a twist tie type closure according to the invention.

FIG. 5 is an embodiment of a closure 110 of the twist tie type according to the invention. The twist tie closure 110 comprises an elongate body 112 having along its longitudinal centre line a thickened rib 114. Numerals 116 and 118 indicate the respective wing parts of the body 112 adjacent the rib 114. The body 112 has a first face 120 and second face 122 (upper face respectively lower face in a strip according to the invention).

Figure 6:
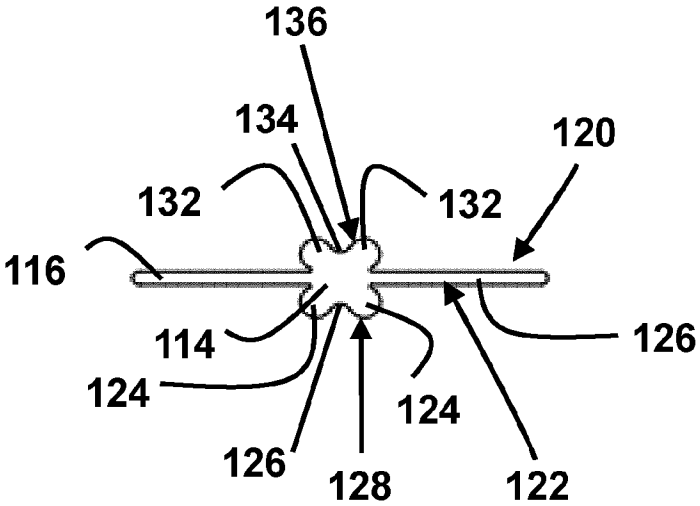
FIG. 6 shows a cross section of the embodiment of FIG. 5.

FIG. 6 shows a cross section of the twist tie embodiment of FIG. 5. At the second face 122 the rib 114 has two projecting parts 124 that are separated by a recess 126. Each projecting part 124 has a curved, in particular rounded top 128. The recess 126 has a curved bottom.

Similarly at the first face 120 the rib 114 has two projecting parts 132 that are separated by a recess 134. A projecting part 132 has a curved (rounded) top 136, while the recess 134 has a curved bottom. The twist tie according to the invention can be applied to a gathered neck of a flexible packaging by bending the closure 110 around the neck and twisting the ends 140, respectively 142 around one another.

The invention claimed is:

1. An elongate closure comprising:
an elongate plastic body having:
a first face; and
a second face; and
one or more thickened ribs extending over the length of the elongate plastic body;
wherein a first thickened rib of the one or more thickened ribs comprises:
a first set of at least two projecting parts separated by a first recess at the second face of the elongate plastic body; and
a second set of at least two projecting parts separated by a second recess at the first face of the elongate plastic body;
wherein a distance between a bottom of the first recess and a bottom of the second recess is larger than a thickness of the elongate plastic body.

2. The closure according to claim 1, wherein the first face is orientated towards an access side of a flexible packaging in a closed position;
wherein the elongate closure is configured for closing the access side of the flexible packaging; and
wherein the second face is orientated away from the access side of the flexible packaging in a closed position.

3. The closure according to claim 1 further comprising a second thickened rib;
wherein the first and second thickened ribs are positioned, respectively one at each longitudinal edge of the elongate plastic body; and
wherein the first and second thickened ribs are spaced apart in a width direction of the elongate plastic body.

4. The closure according to claim 3, wherein:
the second thickened rib comprises:
a first set of at least two projecting parts separated by a first recess at the second face of the elongate plastic body; and
a second set of at least two projecting parts separated by a second recess at the first face of the elongate plastic body; and
an outermost projecting part of each first set of projecting parts of each thickened rib and an outermost projecting part of each second set of projecting parts of each thickened rib are each separated by a third recess.

5. The closure according to claim 4, wherein the third recess between the each of the respective sets of outermost projecting parts has a curved bottom.

6. The closure according to claim 1, wherein the first thickened rib is arranged at a longitudinal center line of the elongate plastic body.

7. The closure according to claim 1, wherein the closure is symmetrical.

8. The closure according to claim 1, wherein each of the projecting parts have a rounded top.

9. The closure according to claim 1, wherein one or more of the first and second recesses have a curved bottom.

10. The closure according to claim 8, wherein one or more of the first and second recesses have a curved bottom; and
wherein at least one of the rounded tops and curved bottoms describe a circular arc section.

11. The closure according to claim 10, wherein the radius of the circular arc section of at least one of the rounded tops is larger than the radius of the circular arc section of at least one of the curved bottoms.

12. The closure according to claim 1, wherein the elongate plastic body and the first thickened rib are made of the same plastic.

13. The closure according to claim 1, wherein the elongate plastic body and the first thickened rib form a single entity.

14. A coil comprising:
the elongate closure of claim 1;
wherein:
the first face is an upper face;
the second face is a lower face; and
the elongate closure is configured to be wound onto the coil for use in a packaging device.

15. The coil according to claim 14, wherein the first thickened rib is positioned at a first longitudinal edge of the elongate plastic body;
wherein a second of the one or more thickened ribs is positioned at a second longitudinal edge of the elongate plastic body; and
wherein the first longitudinal edge and the second longitudinal edge are spaced apart in the width direction of the elongate plastic body.

16. The coil according to claim 15, wherein:
the second of the one or more thickened ribs comprises:
a first set of at least two projecting parts separated by a first recess; and
a second set of at least two projecting parts separated by a second recess; and
an outermost projecting part of each first set of projecting parts of each of the first and second thickened ribs and an outermost projecting part of each second set of projecting parts of each of the first and second thickened ribs are each separated by a third recess.

17. The coil according to claim 14, wherein the elongate plastic body comprises one thickened rib being the first thickened rib arranged at a longitudinal center line of the elongate plastic body.

18. The coil according to claim 14, wherein
a second thickened rib of the one or more thickened ribs comprises:
a first set of at least two projecting parts separated by a first recess; and
a second set of at least two projecting parts separated by a second recess; and
a distance between a bottom of the first recess of the second thickened rib and a bottom of the second recess of the second thickened rib is larger than the thickness of the elongate plastic body.

19. A method of closing an access side of a flexible packaging comprising:

necking the access side of the flexible packaging; and closing the neck with the elongate closure of claim 2.

20. A method of closing an access side of a flexible packaging comprising:

necking the access side of the flexible packaging;

forming a discrete length of an elongate closure from the coil of claim 14; and closing the neck with the elongate closure.

21. The closure according to claim 1, wherein a distance between a bottom of the first recess at the second face and a center plane is larger than half the thickness of the elongate plastic body.

22. The closure according to claim 4, wherein each of the projecting parts have a rounded top.

23. The closure according to claim 4, wherein the closure is symmetrical.

24. The closure according to claim 4, wherein one or more of the first and second recesses have a curved bottom.

25. The closure according to claim 4, wherein the elongate plastic body and the first thickened rib are made of the same plastic.

26. The closure according to claim 4, wherein the elongate plastic body and the first thickened rib form a single entity.

27. The closure according to claim 4, wherein a distance between a bottom of the first recess at the second face and a center plane is larger than half the thickness of the elongate plastic body.

28. The closure according to claim 22, wherein one or more of the first and second recesses have a curved bottom; and wherein at least one of the rounded tops and curved bottoms describe a circular arc section.

29. The closure according to claim 28, wherein at least one of the rounded tops and at least one of the curved bottoms each describe a circular arc section; and wherein the radius of the circular arc section of at least one of the rounded tops is larger than the radius of the circular arc section of at least one of the curved bottoms.

* * * * *